US009745640B2

(12) United States Patent
Valdez et al.

(10) Patent No.: US 9,745,640 B2
(45) Date of Patent: Aug. 29, 2017

(54) QUENCHING TANK SYSTEM AND METHOD OF USE

(71) Applicant: Tenaris Coiled Tubes, LLC, Houston, TX (US)

(72) Inventors: Martin Valdez, Buenos Aires (AR); Marcelo Falcigno, Buenos Aires (AR); Christian Alvarez Tagliabue, Buenos Aires (AR); Jorge Mitre, Houston, TX (US)

(73) Assignee: TENARIS COILED TUBES, LLC, Houston, TX (US)

( * ) Notice: Subject to any disclaimer, the term of this patent is extended or adjusted under 35 U.S.C. 154(b) by 252 days.

(21) Appl. No.: 14/660,677

(22) Filed: Mar. 17, 2015

(65) Prior Publication Data

US 2016/0273063 A1 Sep. 22, 2016

(51) Int. Cl.

| | |
|---|---|
| ***C21D 1/64*** | (2006.01) |
| ***C21D 9/08*** | (2006.01) |
| ***C21D 1/18*** | (2006.01) |
| ***C22C 38/00*** | (2006.01) |

(52) U.S. Cl.

CPC ..... *C21D 1/64* (2013.01); *C21D 1/18* (2013.01); *C21D 9/08* (2013.01); *C22C 38/00* (2013.01)

(58) Field of Classification Search

CPC ..... C21D 1/18; C21D 1/64

USPC ..... 266/113

See application file for complete search history.

(56) References Cited

U.S. PATENT DOCUMENTS

| | | | | |
|---|---|---|---|---|
| 3,662,997 | A | 5/1972 | Bloom | |
| 4,238,119 | A * | 12/1980 | Mitsuyoshi | C21D 9/56 266/100 |
| 2012/0186686 | A1 | 7/2012 | Valdez et al. | |
| 2014/0272448 | A1 | 9/2014 | Valdez et al. | |

FOREIGN PATENT DOCUMENTS

| | | |
|---|---|---|
| EP | 2778239 | 9/2014 |
| GB | 2024871 | 1/1980 |

* cited by examiner

*Primary Examiner* — Scott Kastler
(74) *Attorney, Agent, or Firm* — Fish & Richardson P.C.

(57) ABSTRACT

A quenching tank system includes a cooling tank having an entrance opening adapted to allow a first portion of a heated continuous tube to enter the cooling tank and to allow a first portion of a cooling fluid in the tank to flow out the entrance opening. The cooling tank includes an exit opening adapted to allow a partially cooled second portion of the continuous tube moving through the tank to exit the cooling tank and to allow a second portion of the cooling fluid in the tank to flow out the exit opening. The system also includes a cooling fluid collection and distribution system adapted to collect cooling fluid flowing out of the cooling tank, return the collected cooling fluid to the cooling tank and distribute the cooling fluid in the cooling tank. A method of cooling a heated continuous tube using a quenching tank system is described.

17 Claims, 2 Drawing Sheets

QUENCHING TANK SYSTEM AND METHOD OF USE

TECHNICAL FIELD

This invention relates to, a cooling tank for heated tubular products and more particularly to a quenching tank system for continuous tubes.

BACKGROUND

Quenching is defined as the process of rapid cooling from the austenitic temperature range at rates so fast that diffusion control phase transformations cannot take place. The resulting microstructure would be desirable to be martensitic. The transformation to martensite starts only when the pipe is cooled below the martensitic start temperature (Ms), and is completed only when the pipe is cooled below the martensitic finishing (Mf) temperature. It is desired that the transformation occur through the wall, meaning that the interior of the pipe is also cooled at a fast enough speed to guarantee transformation.

Austenitic temperature range depends on the steel composition. The selection of this temperature is in general the minimum required to guarantee that the transformation will occur, but not too high as to exert grain growth in the material, resulting in loss of toughness and modification of the cooling rate required for quenching. See Table 1 below taken from EP Patent 2778239 for critical cooling rates for different steel chemistries. They are indicated as CR90, indicating the cooling rate that the device should impose in the material should be greater than the CR90 in order to guarantee more than 90% transformation into martensite. As used in this patent application, "CR90" and CR90M" are interchangeable terms wherein the CR stands for cooling rate and 90 stands for 90% martensite and M stands for martensite. Therefore, CR90 and/or CR9OM is the cooling rate (generally provided in degrees C. per second) for a given steel composition to guarantee 90% martensite in the tube.

TABLE 1

Critical Cooling Rates (CR 90) to have more than 90% martensite for selected steel compositions.

| Steel | C (wt %) | Mn (wt %) | Si (wt %) | Cr (wt %) | Mo (wt %) | Other | CR90 (*C/s) | Adequate Hardenability? |
|---|---|---|---|---|---|---|---|---|
| STD1 | 0.13 | 0.80 | 0.35 | 0.52 | 0.13 | Ni, Cu, Ti | >100 | No |
| STD2 | 0.14 | 0.80 | 0.33 | 0.55 | 0.10 | Ni, Cu, Nb—Ti | >100 | No |
| STD3 | 0.14 | 0.80 | 0.34 | 0.57 | 0.32 | Ni, Cu, Nb—Ti | 50 | No |
| CMn1 | 0.17 | 2.00 | 0.20 | — | — | — | 30 | Yes |
| CMn2 | 0.25 | 1.60 | 0.20 | — | — | — | 30 | Yes |
| BTi1 | 0.17 | 1.60 | 0.20 | — | — | B—Ti | 30 | Yes |
| BTi2 | 0.25 | 1.30 | 0.20 | — | — | B—Ti | 25 | Yes |
| CrMo1 | 0.17 | 1.00 | 0.25 | 1.00 | 0.50 | — | 25 | Yes |
| CrMo2 | 0.25 | 0.60 | 0.20 | 1.00 | 0.50 | — | 23 | Yes |
| CrMoBTi1 | 0.17 | 0.60 | 0.20 | 1.00 | 0.50 | B—Ti | 25 | Yes |
| CrMoBTi2 | 0.24 | 0.40 | 0.15 | 1.00 | 0.25 | B—Ti | 25 | Yes |
| CrMoBTi3 | 0.24 | 0.40 | 0.15 | 1.00 | 0.50 | B—Ti | 15 | Yes |
| CrMoBTi4 | 0.26 | 0.60 | 0.16 | 0.50 | 0.25 | B—Ti | 30 | Yes |

Cooling through tubing wall: in some situations, the interior surface of the tubing should be cooled at elevated cooling rates also. EP patent application EP2778239A1 discloses data on the average cooling rate of tubes treated in an industrial quenching heads facility (sprays of water cooling the tube from the external surface). FIG. 4 of the present application (reproduced from FIG. 3 of EP 2778239A1) illustrates cooling rates shown as a function of the pipe Wall Thickness (WT). The shaded area in FIG. 4 corresponds to the wall thickness range typical of coiled tube applications. It is clear that the Cooling Rate in the interior surface decreases as the Wall Thickness increases. When selecting steel chemistries suitable to have more than 90% tempered martensitic, the critical cooling rate of the alloy should be equal or lower than 30° C./s (for this quenching head). If the critical cooling rate of the alloy is equal to 30°/sec, then all gauges typical from continuous tube will typically quench at a higher cooling rate in the interior diameter (ID) (if the heat transfer of the quenching heads is achieved) and quenching is guarantee. The required cooling rate in the ID of the heavier wall product is equal to the critical cooling rate.

A coiled tubing is a continuous metal tube (pipe) typically about 15,000 feet long, but length can be between 5,000 feet to about 40,000 feet. Typically the continuous tube is coiled about a support structure, as known in the art for transportation and further deployment to a well location and then deployment into a wellbore. In certain applications, a heat treatment is applied to the coiled tubing consisting of one or more series of heating and cooling the continuous tube to produce metallurgical changes in the material of the tube that result in the definition of the mechanical properties of the continuous tube. The continuous tube could be heat treated without uncoiling the product, but this method would possess limitations on the capability to achieve uniform properties, as well as the management of tension in the material of the tube that could arise due to change in volume associated to the heating, cooling and phase transformations.

An alternative heat treatment requires the continuous tube to be uncoiled on one end, then heat treated and then coiled at the exit of the heat treating process. When the heat treatment includes a quenching process (the rapid cooling from austenitic temperatures as discussed above) the tube should be subjected to elevated cooling rates that result from the application of a fluid to the heated tube.

In general, continuous tubes (e.g. coiled tubing) are quenched using two methods: (a) quenching heads and/or (b) tanks.

In a prior art quenching head process, eductors (a device for inducing a flow of a fluid from a chamber or vessel by using the pressure of a jet of water, air, steam, etc., to create a partial vacuum in such a way as to entrain the fluid to be removed) are typically placed in distribution lines that are fed by a single pipeline. When one distribution pipe entrance gets clogged due to scale and/or a failure of filtration, a complete set of aligned eductors will stop cooling the tube, and there will be a lower cooling rate of the section of the continuous tube running below such defective educator(s). n such a prior art system, a failed educator of a quenching head system that that would result in inconsistent cooling of the tube, can be overcome by rotating a tube about its longitudinal axis (suitable for pipe of a maximum length of about 42 feet) in the cooling tank. However, rotating a continuous tube of a coiling tubing in a cooling tank is not technical feasible.

In a prior art tank quenching process, the tube is submerged inside a cooling tank. As noted above, a tube of a length of up to about 42 feet may be rotated about its longitudinal axis in order to increase the heat transfer, and alternatively fluid may be jetted inside the tube to help heat extraction from the interior surface.

The cooling heterogeneities of the quench head system may be eliminated by using the tank quenching process. However, in order to accommodate a continuous tube of coiled tubing, a very large tank is needed in order to quench the total length of continuous tube in a coiled tubing. In the case of a coiled tubing which is not uncoiled and entirely immerged into a cooling fluid in a cooling tank, the heat extraction is limited to contacting the outside surface of the coiled tubing.

Therefore, a need exists for an improved quenching tank system for a continuous heated tube of a coiled tubing.

SUMMARY

In an embodiment, the quenching tank system 100 is composed of two tanks, a main cooling tank 160 and a secondary cooling tank 170. The main cooling tank 160 is where the cooling/quenching occurs and the system includes two collectors 105 which are used to provide the cooling fluid to the eductors (e.g. nozzles) 102. The eductors 102 are used to create a cooling fluid flow in direction F which is countercurrent to the continuous tube movement in direction D to provide cooling/quenching capability at the entrance end 162 to the main cooling tank 160. However it will be understood that other means to create a counter flow can also be used. Entrance opening 163 in the entrance end 162 and exit opening 165 in the exit end 164 allows heated cooling fluid to flow out of the main cooling tank 160, collected, cooled, and then recirculated to the main cooling tank. A secondary cooling tank 170 is used to collect the cooling fluid that flows out of and/or overflows from the main cooling tank 160. Heated cooling fluid collected in the secondary cooling tank is pumped to one or more heat exchangers (i.e. cooling tower(s)) for cooling and recirculation into the main cooling tank 160 via the collector system 105 and eductors 102. However it will be understood that other means can be used in order to collect the heated cooling liquid flowing out of the main cooling tank, such as allowing the exiting cooling fluid to collect on a floor into a system of channels and/or drains and pumping the collected heated cooling fluid to heat exchangers (e.g. cooling towers).

In an embodiment, a method of cooling a heated continuous tube is disclosed. The method includes: providing a cooling tank having an entrance end including an entrance opening, an exit end including an exit opening, said cooling tank having a cooling fluid therein; inserting a first portion of the heated continuous tube into the entrance opening; contacting with a first portion of the cooling fluid in the cooling tank the first portion of the heated tube entering the cooling tank; flowing the first portion of the cooling fluid out the entrance opening; continuously moving the heated continuous tube linearly through the cooling tank; contacting with a second portion of the cooling fluid in the cooling tank a second portion of the heated continuous tube moving through the cooling tank; exiting the cooling tank with at least a partially cooled second portion of the continuous tube through the exit opening; and flowing the second portion of the cooling fluid out the exit opening. The method of further includes providing a cooling fluid collection and distribution system; collecting the first portion and the second portion of the cooling fluid flowing out of the cooling tank; and returning the collected cooling fluid to the cooling tank and distributing the returned cooling fluid in the cooling tank.

In an embodiment, the method includes providing a secondary cooling tank positioned below the cooling tank; and collecting cooling fluid flowing out of the entrance opening and exit opening of the cooling tank in the secondary cooling tank.

In an embodiment the method includes: transferring collected cooling fluid from the secondary cooling tank to a heat exchanger; cooling the collected cooling fluid in the heat exchanger; and returning the cooled cooling fluid to the cooling tank.

In an embodiment, the method further includes providing a plurality of eductors; and directing with the eductor cooling fluid in the cooling tank toward the entrance end of the tank.

In an embodiment, the method includes providing a plurality of push rollers and support rollers; and guiding with the push rollers and support rollers the continuous tube linearly from the entrance end through the cooling tank to the exit end of the cooling tank.

In an embodiment, the method includes providing at least a portion of the entrance opening and exit opening in a same horizontal plane.

In an embodiment, the method includes providing additional eductors; and directing with the additional eductors at least a portion of cooling fluid in the cooling tank to overflow a top of one or more side walls of the cooling tank.

In some implementations, the method includes forming a 90% marensite by maintaining a minimum relative velocity (Vmin) of movement of the continuous tubing through the cooling tank with water as the cooling fluid, wherein the water is at a temperature less than or equal to 35° C. The minimum relative velocity (Vmin) in meters per second is calculated by the following equation: $Vmin>1/100+1/145\times(WT-2.77)+1/1500\times(CR90M-20)$; wherein a continuous tube wall thickness (WT) in millimeters is between 2.77 mm and 7.11 mm; and CR90M is the cooling rate needed to form the 90% martensite for a given steel and is 20 and 50° C. per second. The CR90M is the cooling rate of the interior surface of the tube when cooling the tube from the outside surface of the tube.

In some implementations, the method includes forming a 90% marensite by maintaining a minimum relative velocity (Vmin) of movement of the continuous tubing through the cooling tank with water as the cooling fluid, wherein the water is at a temperature greater than to 35° C. and less than 60° C. The minimum relative velocity (Vmin) in meters per second is calculated by the following equation: $Vmin>1/20+1/45\times(WT-2.77)+1/300\times(CR90M-20)$;

wherein a continuous tube wall thickness (WT) in millimeters is between 2.77 mm and 7.11 mm; and CR90M is the cooling rate needed to form the 90% martensite for a given steel and is 20 and 50° C. per second. The CR90M is the cooling rate of the interior surface of the tube when cooling the tube from the outside surface of the tube.

In some implementations, the method includes forming a 90% marensite through a wall of the tube by maintaining a minimum fluid flow rate of the cooling fluid (Qw) in $m^3/s$ in a closed collection and distribution system necessary to form 90% martensitic through a wall of the tube as the tube moves through the cooling tank. The minimum fluid flow rate (Qw) is expressed by the relationship: $Qw>1000\times Ss\times Vt/DTw$; wherein Ss is the cross section in square meters of the tube being cooled; Vt is the tube speed in m/s; and DTw is the quenching-fluid temperature-drop in the heat exchanger in ° C.

In some implementations, the method includes providing a cooling tank with a cross section of the cooling tank (Sw) in square meters, said Sw taken in a direction (D) perpendicular to the direction of continuous tube movement, relative to the cross section in square meters of the continuous tube being cooled (Ss) is expressed by the relationship: $Sw>37\times Ss\times Vt\times tstop/Lw$; wherein Vt is the continuous tube speed in m/s and tstop is a time of a cessation of cooling in the heat exchanger in seconds.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

"Quenching fluid", "cooling fluid" and "quenching/cooling fluid" are used interchangeably in this disclosure. It will be understood that a cooling fluid and quenching fluid may be water or other suitable quenching liquid.

It will be understood that cooling is inherently part of the quenching process and as used herein the term "quenching" is broader than and includes the term "cooling" and that the term "cooling tank" is a subset of a "quench tank."

It will be understood that "s" is used in certain context herein as an abbreviation for the time interval "second" and "mm" is used certain context herein as an abbreviation for the distance measurement "millimeter" and "° C." is used as abbreviation for degrees Celsius (also sometimes known as degrees Centigrade) and "wt %" is used as an abbreviation for "% by weight".

It will be understood that as used in this patent application, "CR90" and CR90M" are interchangeable terms wherein the CR stands for cooling rate and 90 stands for 90% martensite and M stands for martensite. Therefore, CR90 and/or CR90M is the cooling rate (generally provided in degrees C. per second) for a given steel composition to guarantee 90% martenisite in the tube, and wherein CR90 and/or CR90 M is the rate of cooling of the interior surface of the tube when cooling the tube with fluid from the outside surface of the tube.

Figure 1:
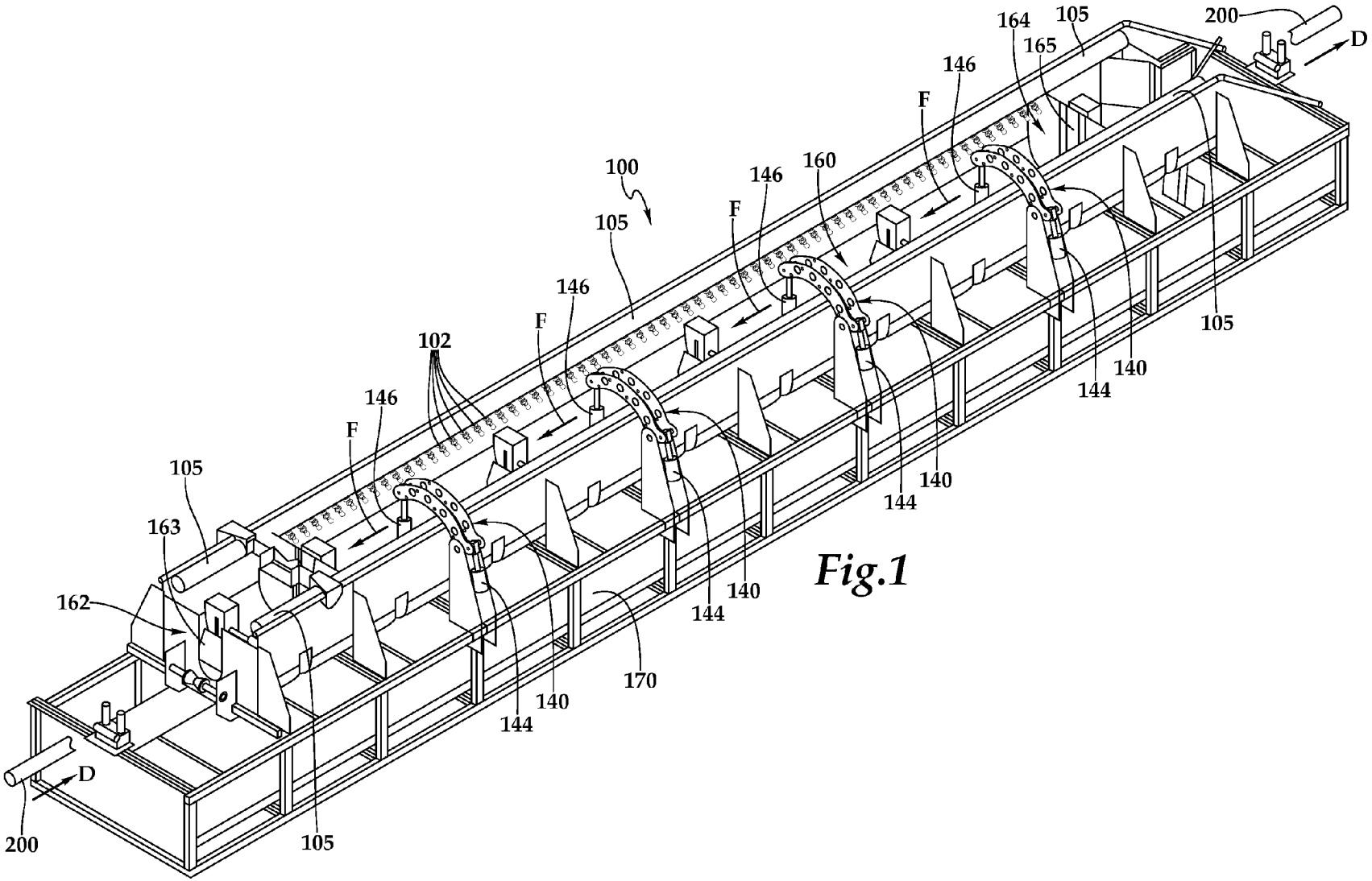
FIG. 1 is perspective view from above of a quench tank of the present disclosure.
Figure 2:
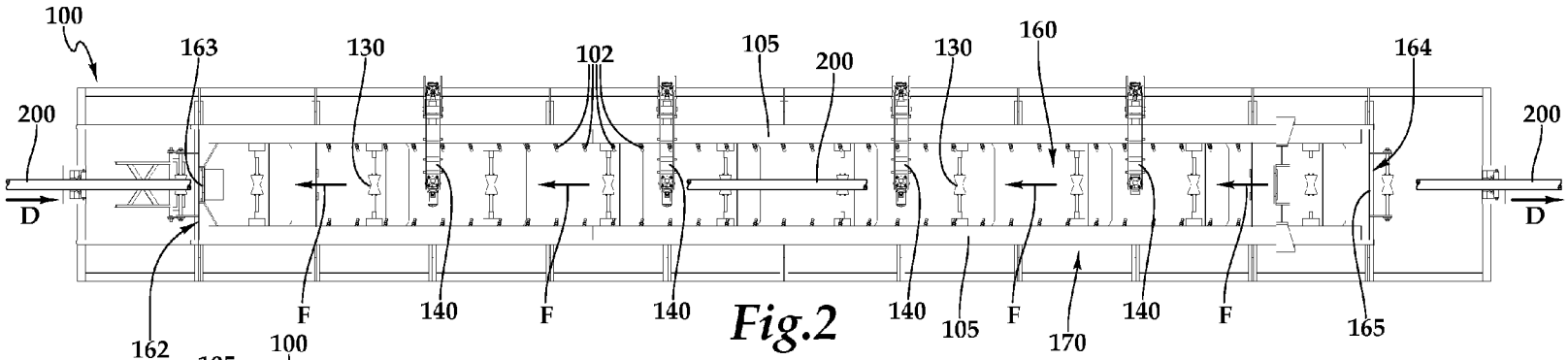
FIG. 2 is a top view of the quench tank of FIG. 1.
Figure 4:
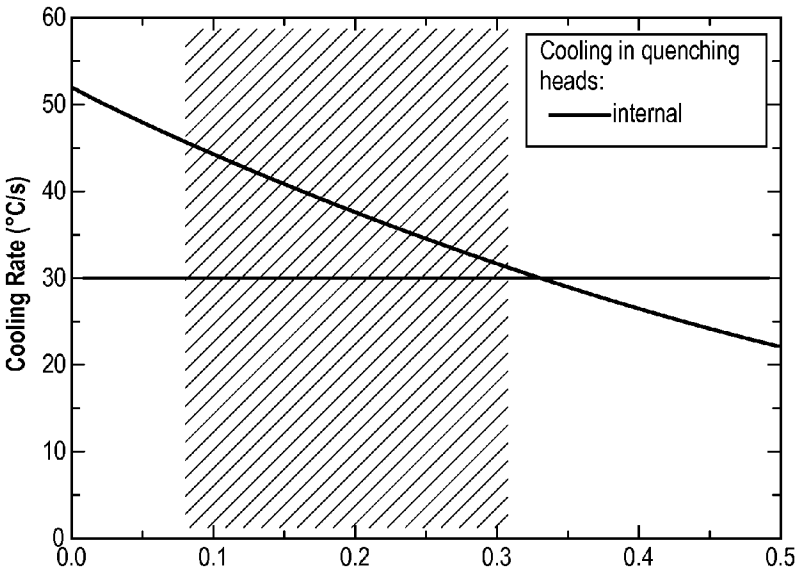
FIG. 4 is a graph of cooling rates as a function of tube wall thickness
Figure 3:
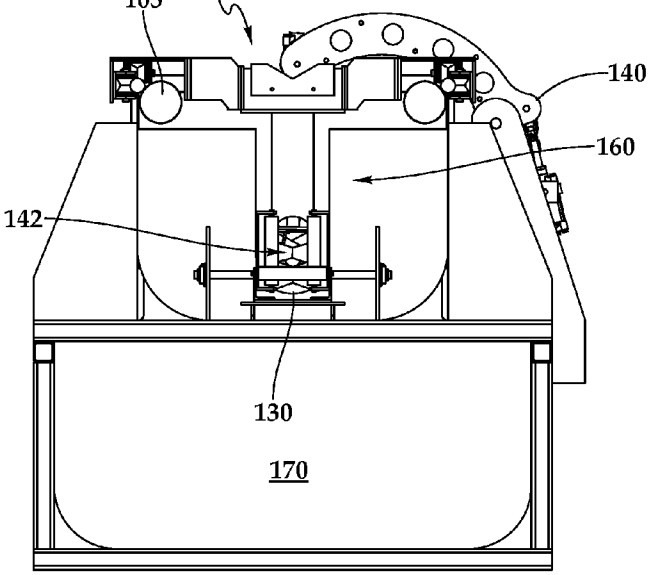
FIG. 3 is a front end view of the quench tank of FIG. 1.

Referring now to FIG. 1, illustrates a quenching tank system 100 for quenching (e.g. cooling) a continuous tube of a coiled tubing. In general, the quenching tank system 100 includes a cooling tank 160 and in some embodiments a secondary cooling tank 170. Collectors 105 which are used to distribute the quenching/cooling fluid (e.g. water) and to feed eductors 102 are disposed above and in cooling tank 160. The eductors 102 are used to create an overall quenching fluid flow direction F which is opposite to the continuous tube 200 movement direction D through the cooling tank 100. It will be understood that localized turbulence of the cooling fluid and fluid rotation may occur. It will be understood that other means of fluid directors (e.g. nozzles, may be used to create a counter fluid flow in direction F. In addition, the cooling tank 160 includes backing rolls 130 and push rollers 142 for directing and moving the continuous tube from an entrance end 162 of a main cooling tank 160 to an exit end 164 of the quenching tank system 100. The backing rolls are used in order to give support to the continuous tube 200 as it moves through the main cooling tank 160. The push rollers 142 are used to press the tube 200 against the backing roll 130 to assure a straight trajectory. It will be understood that other means may be used to direct and move the continuous tube 200 through the quenching tank system 100 in a straight trajectory and to move the tube 200 through the main cooling tank 160.

The entrance end 162 and exit end 164 of the main cooling tank 160 includes entrance opening 163 to allow for passage of the continuous tube 200 into the main cooling tank 160 and for exit opening 165 to allow passage of the continuous tube out 200 of the tank 160. The openings 163 and 165 also allow for circulation of the quenching/cooling fluid in the quenching tank system 100.

The continuous tube 200 enters continuously through the entrance 162 with minimum bending applied to the tubing. The backing rolls 130 and push rollers 142 apply force to the tube 200 perpendicular to the direction D of tube movement. The push rollers 142 are part of an adjustable push tool apparatus 140 that includes adjustment pistons 144 and 146 that can be used to position the push rollers 142 in contact with different size of diameter continuous tubes 200 being fed through the rolls 142 and 130. The speed and direction D of movement of the tube is controlled by other rollers (not shown) that are positioned outside the main cooling tank 160.

As the heated continuous tube 200 enters the cooling fluid, it begins to cool and gets hard and brittle and hence it is not recommended that the continuous tube be bent during the quenching operation. Bending is not only difficult but dangerous for the integrity of the continuous tube. A desirable feature of this invention is that the continuous tube enters the main cooling tank 160 through entrance opening 163 in the entrance end 162 and exits through exit opening 165 in the exit end 164. The entrance opening 163 and exit opening 165 are aligned with each other in a generally horizontal plane. Therefore, minimum bending is applied to the continuous tube 200 as it moves horizontally and linearly through the main cooling tank 160. This configuration is preferable to a prior art type cooling tank configured with no side openings wherein access to the cooling fluid would necessarily occur by bending the continuous tube downward over the sides of the tank to contact the cooling fluid in the tank. The depth of such a prior art type tank would be related to the angle of impingement with the surface of the cooling fluid, thereby requiring a very large tank for commercial put through rates. This is because the angle of impingement must be minimized to reduce strain in the tube material as it enters a prior art type tank. As the tube enters a prior art type tank the tube will move down in the tank and must be brought back up to exit the tank. Keeping the soft bending of the tube downward and upward during entering and exiting in an acceptable range could only be accomplished in a prior art type cooling tank by using a long tank.

When the heated continuous tube 200 enters the main cooling tank 160 it produces localized heating of a portion of the cooling fluid that is in contact with and near the heated tubing. As the cooling fluid heats up over time due to exposure to the heated tubing, that heated portion of the cooling fluid loses heat extraction capability. If the cooling capacity at the tank entrance is low it may not be possible to achieve the desired CR 90 and other metallic properties. To overcome the loss of heat extraction ability of the heated cooling fluid, the tube must be moved faster and a longer cooling tank may be needed. However such a configuration may result in undesired phase transformations (i.e. the cooling fluid might flash into steam). Hence it is more efficient and hence preferable to bring fresh cooling/quenching fluid to the entrance of the cooling tank where the continuous tube is entering the cooling fluid. In the present invention cooling fluid flows in direction F which is opposite to the direction D of the tubing movement through the tank. Cooling fluid heated by the entering heated continuous tube 200 near the entrance of the continuous tube 200 into the main cooling tank 160 the entrance needs to be evacuated (through the entrance opening 163) and transferred to a heat exchanger and returned to the main cooling tank 160 through the educators 102 in a continuous circulation process.

Heat extraction at the surface of the tubing is associated with the heat transfer conditions. Maximum heat transfer is achieved by the relative movement of the tubing in direction D counter to the cooling fluid flow direction F. In some implementations, water is provided to the main cooling tank 160 through eductors 102 positioned and configured to produce high turbulence in the cooling tank and provide continuous overflow of the cooling fluid from the tank to a collection channel(s) and/or drains outside the tank.

Experimental Data

Test data indicates that the quenching of a medium carbon steel with and without eductors results in a variation in the amount of martensite in the microstructure from 90% down to 78% as shown in the table below. Considering experimental error, 86% is satisfactory and is near the design target of 90%. Hardness is related to the content of martensite which is a hard constituent of the microstructure of the tube. So hardness and martensite content are both evidence of a better quenching result

| Trial | QT3 | QT4 |
|---|---|---|
| Eductors | No | Yes |
| Avg. HRC | 46.0 | 47.0 |
| Std. Dv. HRC | 1.8 | 1.2 |
| Max. HRC | 48.2 | 49.3 |
| Min. HRC | 39.8 | 43.5 |
| Avg. HV | 459 | 473 |
| M fraction | 78% | 86% |

The hardness is measured using the Rockwell scale (HRC) and with the Vickers Pyramid number (HV), according to the table above we can see that the hardness is improved by the use of eductors. The Martensite fraction is also improved by the use of eductors. Hardness is related to the content of martensite which is a hard constituent of the microstructure. So both hardness and martensite content are both evidence of a better quenching. The criticality for the control of fluid flow increases as the pipe is bigger and thicker, or the chemistry hardenability decreases.

The time of the main cooling is related to the productivity of the line (linear velocity) and the dimensions of the pipe. Calculations for different products were estimated.

| Tube | | | | | Quenching Tank | |
|---|---|---|---|---|---|---|
| | | | | | Time | |
| Pipe OD In | Pipe WT In | Linear Weight lbs/ft | HT Speed fpm | Expected productivity Ston/h | (1050° C.-120° C.) s | Length m |
| 1.000 | 0.109 | 1.04 | 68 | 2.12 | 7.8 | 2.69 |
| 1.250 | 0.175 | 2.01 | 68 | 4.11 | 12.9 | 4.45 |
| 1.500 | 0.204 | 2.83 | 72 | 6.11 | 17.3 | 6.33 |
| 1.750 | 0.250 | 4.01 | 72 | 8.67 | 21.6 | 7.91 |
| 2.000 | 0.280 | 5.16 | 72 | 11.14 | 24.6 | 9.00 |
| 2.375 | 0.300 | 6.66 | 60 | 12.00 | 26.9 | 8.20 |
| 2.625 | 0.300 | 7.47 | 52 | 11.65 | 27.3 | 7.21 |
| 2.875 | 0.190 | 5.46 | 68 | 11.14 | 17.3 | 5.97 |

OD: Outside Diameter
WT: Wall thickness
HT: Heat treatment

OD: Outside Diameter
WT: Wall thickness
HT: Heat treatment

During the quenching process the temperature of the cooling fluid increases because of the heat released by the pipe (which is cooled from austenitization temperature down to about 150° C.). When water is used for the cooling fluid, the maximum working temperature of the water in the main cooling tank pool is 60° C. At higher temperatures the heat extraction from the tube to the quenching media (e.g. water) is too low to reach critical cooling rates needed to form at least 90% martensite. In order to avoid excessive heating of the quenching fluid, it is recirculated in a closed loop through a cooling facility (for example a cooling tower). The quenching-fluid flow rate (Qw) in $m^3/s$ in the circuit formed by the main tank and the cooling facility should be:

$$Qw > 1000 \times Ss \times Vt/DTw$$

where Ss is the cross section in square meters of the pipe being cooled, Vt is the tube speed in m/s and DTw is the quenching-fluid temperature-drop in the cooling facility (for example in the cooling tower) in ° C.

The cross section of the main cooling tank Sw (area measured in square meters in the direction perpendicular to that of the pipe movement) has to be large enough to avoid excessive heating of the quenching fluid due to an unexpected stop of the cooling facility. Sw depends on the average time needed to resume the cooling facility operation (tstop) in the following way:

$$Sw > 37 \times Ss \times Vt \times tstop/Lw$$

where Lw is the length of the cooling tank in meters in the direction of pipe movement, tstop is in seconds, and the other parameters were previously defined. For example, if it is needed to allow for a 1200 seconds stop of the cooling facility without affecting the quenching process, the minimum cross section Sw should be 1.69 $m^2$ when Ss is 9.76E-4 $m^2$ (pipe with OD 2 inches and WT 0.28 inches), Vt is 0.36 m/s (72fpm) and Lw is 9 m.

Water flow in the pool and line speed have to be selected in order to guarantee a minimum relative velocity (Vmin) between the pipe and the quenching media. Otherwise the heat extraction during quenching is not enough to reach the critical cooling rate (CR90 M) necessary to form at least 90% martensite. The minimum relative velocity of the tube as it moves through the main cooling tank depends on pipe wall thickness (WT) and critical cooling rate (CR90M) necessary to form 90% martensitic in the following way:

$$V\min > 1/100 + 1/145 \times (WT - 2.77) + 1/1500 \times (CR90M - 20)$$

where Vmin is in m/s, WT is in mm and CR90M is in ° C./s. The CR90M is the cooling rate of the interior surface of the tube when cooling the tube from the outside surface of the tube. The expression is valid for WT=2.77-7.62 mm, CR90M=20 to 50° C,/s and water temperature up to 35° C.

For water temperature up to 60° C. the following expression is valid for the same WT and CR90M ranges previously stated (larger Vmin than in previous case are needed to compensate for the reduction in the heat extraction coefficients due to the higher cooling media temperature):

$$V\min > 1/20 + 1/45 \times (WT - 2.77) + 1/300 \times (CR90M - 20)$$

A number of embodiments of the invention have been described. Nevertheless, it will be understood that various modifications may be made without departing from the spirit and scope of the invention. Accordingly, other embodiments are within the scope of the following claims.

What is claimed is:

1. A quenching tank system comprising:

a cooling tank having an entrance end including an entrance opening, an exit end including an exit opening, said entrance opening adapted to allow a first portion of a heated continuous tube to enter the cooling tank through the entrance opening, and said entrance opening further adapted to allow a first portion of a cooling fluid in the cooling tank that has been heated by the first portion of the heated continuous tube entering the cooling tank to flow out the entrance opening, and said exit opening adapted to allow a partially cooled second portion of the heated continuous tube moving through the cooling tank to exit the cooling tank through the exit opening, and said exit opening further adapted to allow a second portion of the cooling fluid in the cooling tank, that has been heated by the second portion of the heated continuous tube in the tank to flow out the exit opening; and said quenching tank system further comprising a cooling fluid collection and distribution system adapted to collect cooling fluid flowing out of the cooling tank, return the collected cooling fluid to the cooling tank and distribute the cooling fluid in the cooling tank, said collection and distribution system including at least one eductor that is adapted to direct a portion of the cooling fluid in the cooling tank toward the entrance end of the cooling tank and out the entrance opening of the cooling tank concurrently with inserting the first portion of the heated continuous tube through the entrance opening.

2. The quenching tank system of claim 1, wherein the cooling fluid collection and distribution system comprises a secondary cooling tank positioned below the cooling tank, said secondary cooling tank adapted to collect the first portion of the cooling fluid flowing out of the entrance opening and the second portion of the cooling fluid flowing out of the exit opening of the cooling tank.

3. The quenching tank system of claim 2, wherein the cooling fluid collection and distribution system further comprises piping connecting the secondary cooling tank to at least one heat exchanger adapted to cool the collected cooling fluid in the secondary cooling tank and return the cooled cooling fluid to the cooling tank.

4. The quenching tank system of claim 1, further comprising a plurality of push rollers and support rollers adapted to guide the heated continuous tube linearly from the entrance end through the cooling tank to the exit end of the cooling tank.

5. The quenching tank system of claim 1, wherein at least a portion of the entrance opening and the exit opening are in a horizontal plane.

6. A quenching tank system comprising:

a cooling tank having an entrance end including an entrance opening, an exit end including an exit opening, said entrance opening adapted to allow a first portion of a heated continuous tube to enter the cooling tank through the entrance opening, and said entrance opening further adapted to allow a first portion of a cooling fluid in the cooling tank that has been heated by the first portion of the continuous heated tube entering the cooling tank to flow out the entrance opening, and said exit opening adapted to allow a partially cooled second portion of the heated continuous tube moving through the cooling tank to exit the cooling tank through the exit opening, and said exit opening further adapted to allow a second portion of the cooling fluid in the tank, that has been heated by the second portion of the heated continuous tube in the cooling tank to flow out the exit opening; and said quenching tank system further comprising a cooling fluid collection and distribution system adapted to collect cooling fluid flowing out of the cooling tank, return the collected fluid to the cooling tank and distribute the cooling fluid in the cooling tank, wherein the cooling fluid collection and distribution system includes a plurality of eductors that are adapted to cause at least a portion of the cooling fluid in the cooling tank to overflow a top of one or more side walls of the cooling tank.

7. The quenching tank system of claim 1 adapted to provide a minimum fluid flow rate of the cooling fluid (Qw) in $m^3/s$ in the cooling fluid collection and distribution system as the heated continuous tube moves through the cooling tank is expressed by a relationship:

$$Qw > 1000 \times Ss \times Vt/DTw$$

wherein Ss is a cross section in square meters of the heated continuous tube being cooled; Vt is a tube speed in m/s; and DTw is a decrease in temperature of the cooling fluid in a heat exchanger in ° C.

8. The quenching tank system of claim 1, wherein a cross section (Sw) of the cooling tank in square meters is defined by a relationship:

$$Sw > 37 Ss \times Vt \times t\text{stop}/Lw,$$

wherein Sw is taken in a direction (D) perpendicular to a direction of heated continuous tube movement, relative to a cross section (Ss) in square meters of the heated continuous tube being cooled; and Vt is a continuous tube speed in m/s and tstop is a time of a cessation of cooling in a heat exchanger in seconds.

9. A method of cooling a heated continuous tube comprising:

providing a cooling tank having an entrance end including an entrance opening, an exit end including an exit opening, said cooling tank having a cooling fluid therein;

inserting a first portion of the heated continuous tube into the entrance opening;

contacting with a first portion of the cooling fluid in the cooling tank the first portion of the heated continuous tube entering the cooling tank;

continuously moving the heated continuous tube linearly through the cooling tank;

contacting with a second portion of the cooling fluid in the cooling tank a second portion of the heated continuous tube moving through the cooling tank;

exiting the cooling tank with at least a partially cooled second portion of the heated continuous tube through the exit opening; and providing a cooling fluid collection and distribution system including at least one eductor and a secondary cooling tank positioned below the cooling tank;

directing with the at least one eductor at least a portion of cooling fluid in the cooling tank toward the entrance opening of the cooling tank concurrently with inserting the first portion of the heated continuous tube through the entrance opening;

collecting the first portion and the second portion of the cooling fluid flowing out of the cooling tank in the secondary cooling tank; and returning the collected cooling fluid to the cooling tank and distributing the returned cooling fluid in the cooling tank.

10. The method of claim 9 further comprising:

transferring collected cooling fluid from the secondary cooling tank to at least one heat exchanger;

cooling the collected cooling fluid in the heat exchanger; and returning the cooled cooling fluid to the cooling tank.

11. The method of claim 9 further comprising:

providing a plurality of push rollers and support rollers; and guiding with the push rollers and support rollers the heated continuous tube linearly from the entrance end of the cooling tank through the cooling tank to the exit end of the cooling tank.

12. The method of claim 9 wherein providing the cooling tank further comprises providing at least a portion of the entrance opening and exit opening in a same horizontal plane.

13. A method of cooling a heated continuous tube comprising:

providing a cooling tank having an entrance end including an entrance opening, an exit end including an exit opening, said cooling tank having a cooling fluid therein;

inserting a first portion of the heated continuous tube into the entrance opening;

contacting with a first portion of the cooling fluid in the cooling tank the first portion of the heated continuous tube entering the cooling tank;

flowing the first portion of the cooling fluid out the entrance opening;

continuously moving the heated continuous tube linearly through the cooling tank;

contacting with a second portion of the cooling fluid in the cooling tank a second portion of the heated continuous tube moving through the cooling tank;

exiting the cooling tank with at least a partially cooled second portion of the heated continuous tube through the exit opening;

flowing the second portion of the cooling fluid out the exit opening;

providing at least one eductor; and directing with the at least one eductor cooling fluid in the cooling tank toward the entrance end of the cooling tank;

providing additional eductors; and directing with the additional eductors at least a portion of cooling fluid in the cooling tank to overflow a top of one or more side walls of the cooling tank.

14. A method of cooling a heated continuous tube comprising:

providing a cooling tank having an entrance end including an entrance opening, an exit end including an exit opening, said cooling tank having a cooling fluid therein;

inserting a first portion of the heated continuous tube into the entrance opening;

contacting with a first portion of the cooling fluid in the cooling tank the first portion of the heated continuous tube entering the cooling tank;

flowing the first portion of the cooling fluid out the entrance opening;

continuously moving the heated continuous tube linearly through the cooling tank;

contacting with a second portion of the cooling fluid in the cooling tank a second portion of the heated continuous tube moving through the cooling tank;

exiting the cooling tank with at least a partially cooled second portion of the heated continuous tube through the exit opening;

flowing the second portion of the cooling fluid out the exit opening; and forming a 90% marensite by maintaining a minimum relative velocity (Vmin) of movement of the heated continuous tube through the cooling tank with water as the cooling fluid, wherein the water is at a temperature less than or equal to 35° C., said minimum relative velocity (Vmin) of movement in meters per second is calculated by the following equation:

$$V\text{min} > 1/100 + 1/145 \times (\text{WT} - 2.77) + 1/1500 \times (\text{CR90M} - 20)$$

wherein a continuous tube wall thickness (WT) in millimeters is between 2.77 mm and 7.11 mm; and a cooling rate (CR90M) is 20 to 50° C. per second.

15. A method of cooling a heated continuous tube comprising:

providing a cooling tank having an entrance end including an entrance opening, an exit end including an exit opening, said cooling tank having a cooling fluid therein;

inserting a first portion of the heated continuous tube into the entrance opening;

contacting with a first portion of the cooling fluid in the cooling tank the first portion of the heated continuous tube entering the cooling tank;

flowing the first portion of the cooling fluid out the entrance opening;

continuously moving the heated continuous tube linearly through the cooling tank;

contacting with a second portion of the cooling fluid in the cooling tank a second portion of the heated continuous tube moving through the cooling tank;

exiting the cooling tank with at least a partially cooled second portion of the heated continuous tube through the exit opening;

flowing the second portion of the cooling fluid out the exit opening; and forming a 90% marensite by maintaining a minimum relative velocity (Vmin) of movement of the heated continuous tube through the cooling tank with water as the cooling fluid, wherein the water is at a temperature greater than to 35° C. and less than 60° C., said minimum relative velocity (Vmin) of movement in meters per second is calculated by the following equation $$Vmin>1/20+1/45\times(WT-2.77)+1/300\times(CR90M-20)$$

wherein a continuous tube wall thickness (WT) in millimeters is between 2.77 mm and 7.11 mm; and a cooling rate (CR90M) is between 20 to 50 ° C. per second.

16. A method of cooling a heated continuous tube comprising:

providing a cooling tank having an entrance end including an entrance opening, an exit end including an exit opening, said cooling tank having a cooling fluid therein;

inserting a first portion of the heated continuous tube into the entrance opening;

contacting with a first portion of the cooling fluid in the cooling tank the first portion of the heated continuous tube entering the cooling tank;

flowing the first portion of the cooling fluid out the entrance opening;

continuously moving the heated continuous tube linearly through the cooling tank;

contacting with a second portion of the cooling fluid in the cooling tank a second portion of the heated continuous tube moving through the cooling tank;

exiting the cooling tank with at least a partially cooled second portion of the heated continuous tube through the exit opening;

flowing the second portion of the cooling fluid out the exit opening; and forming a 90% marensite by maintaining a minimum fluid flow rate of the cooling fluid (Qw) in $m^3$in a fluid collection and distribution system necessary to form 90% martensitic as the heated continuous tube moves through the cooling tank is expressed by a relationship:

$$Qw>1000\times Ss\times Vt/DT$$

wherein Ss is a cross section in square meters of the heated continuous tube being cooled; Vt is a continuous tube speed in m/s; and DTw is a decrease in temperature of the cooling fluid in a heat exchanger in ° C.

17. A method of cooling a heated continuous tube comprising:

providing a cooling tank having an entrance end including an entrance opening, an exit end including an exit opening, said cooling tank having a cooling fluid therein and having a cross section (Sw) of the cooling tank in square meters, said Sw taken in a direction (D) perpendicular to a direction of heated continuous tube movement, relative to the cross section (Ss) in square meters of the continuous tube being cooled is expressed by a relationship:

$$Sw>37Ss\times Vt\ \mathbf{33}\ tstop/Lw$$

wherein Vt is a continuous tube speed in m/s and tstop is a time in seconds of a cessation of cooling in a heat exchanger inserting a first portion of the heated continuous tube into the entrance opening;

contacting with a first portion of the cooling fluid in the cooling tank the first portion of the heated continuous tube entering the cooling tank;

flowing the first portion of the cooling fluid out the entrance opening;

continuously moving the heated continuous tube linearly through the cooling tank;

contacting with a second portion of the cooling fluid in the cooling tank a second portion of the heated continuous tube moving through the cooling tank;

exiting the cooling tank with at least a partially cooled second portion of the heated continuous tube through the exit opening; and flowing the second portion of the cooling fluid out the exit opening.

* * * * *